US008062817B2

(12) United States Patent
Wu

(10) Patent No.: US 8,062,817 B2
(45) Date of Patent: Nov. 22, 2011

(54) CROSSLINKED RESIN MIXTURE BACKING LAYER CONTAINING PHOTOCONDUCTOR

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 374 days.

(21) Appl. No.: 12/413,852

(22) Filed: Mar. 30, 2009

(65) Prior Publication Data

US 2010/0248102 A1 Sep. 30, 2010

(51) Int. Cl.
*G03G 5/04* (2006.01)

(52) U.S. Cl. ... 430/58.8; 430/56; 430/58.05; 430/58.35; 430/58.75

(58) Field of Classification Search ..... 430/56, 430/58.05, 58.35, 58.75, 58.8
See application file for complete search history.

(56) References Cited

U.S. PATENT DOCUMENTS

| | | | |
|---|---|---|---|
| 4,654,284 | A | 3/1987 | Yu et al. |
| 5,021,309 | A | 6/1991 | Yu |
| 5,069,993 | A | 12/1991 | Robinette et al. |
| 5,096,795 | A | 3/1992 | Yu |
| 5,919,590 | A | 7/1999 | Yu et al. |
| 5,935,748 | A | 8/1999 | Yu et al. |
| 6,303,254 | B1 | 10/2001 | Yu et al. |
| 6,528,226 | B1 | 3/2003 | Yu et al. |
| 6,913,863 | B2 | 7/2005 | Wu et al. |
| 6,939,652 | B2 | 9/2005 | Yu |
| 7,910,183 | B2 | 3/2011 | Wu |
| 2008/0241720 | A1 | 10/2008 | Wu et al. |
| 2009/0004587 | A1 | 1/2009 | Abu-Abed et al. |
| 2010/0247918 | A1 | 9/2010 | Wu |
| 2010/0247919 | A1 | 9/2010 | Wu |
| 2010/0248103 | A1 | 9/2010 | Wu |
| 2010/0248104 | A1 | 9/2010 | Wu |
| 2010/0248106 | A1 | 9/2010 | Wu |
| 2010/0248107 | A1 | 9/2010 | Wu et al. |
| 2010/0248108 | A1 | 9/2010 | Wu et al. |
| 2010/0249322 | A1 | 9/2010 | Wu |

OTHER PUBLICATIONS

Jin Wu et al., U.S. Appl. No. 12/033,247 on Anticurl Backside Coating (ACBC) Photoconductors, filed Feb. 19, 2008.
Jin Wu et al., U.S. Appl. No. 12/033,267 on Overcoat Containing Fluorinated Poly(Oxetane) Photoconductors, filed Feb. 19, 2008.

*Primary Examiner* — Peter Vajda
(74) *Attorney, Agent, or Firm* — Oliff & Berridge, PLC

(57) ABSTRACT

A photoconductor that includes, for example, a backing layer, a supporting substrate, a photogenerating layer, and a charge transport layer, and where the outermost layer of the backing layer is comprised of a mixture of a glycoluril resin and a polyacetal resin.

33 Claims, No Drawings

CROSSLINKED RESIN MIXTURE BACKING LAYER CONTAINING PHOTOCONDUCTOR

CROSS REFERENCE TO RELATED APPLICATIONS

Copending U.S. application Ser. No. 12/413,627, U.S. Publication No. 20100248103, filed Mar. 30, 2009, entitled Resin Mixture Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a glycoluril resin, and a polyol resin mixture.

Copending U.S. Application No. 12/413,633, U.S. Publication No. 20100249322, filed Mar. 30, 2009, entitled Fluorinated Sulfonic Acid Polymer Grafted Polyaniline Containing Intermediate Transfer Members, the disclosure of which is totally incorporated herein by reference, illustrates an intermediate transfer member comprised of a substrate, and in contact therewith a polyaniline having grafted thereto a fluorinated sulfonic acid polymer.

Copending U.S. application Ser. No. 12/413,638, U.S. Publication No. 20100247918, filed Mar. 30, 2009, entitled Perfluoropolyether Polymer Grafted Polyaniline Containing Intermediate Transfer Members, the disclosure of which is totally incorporated herein by reference, illustrates an intermediate transfer member comprised of a substrate and in contact with the substrate a polyaniline grafted perfluoropolyether phosphoric acid polymer.

Copending U.S. application Ser. No. 12/413,642, U.S. Publication No. 20100247919, filed Mar. 30, 2009, entitled Fluorotelomer Grafted Polyaniline Containing Intermediate Transfer Members, the disclosure of which is totally incorporated herein by reference, illustrates An intermediate transfer member comprised of a substrate, and a layer comprised of polyaniline having grafted thereto a fluorotelomer.

Copending U.S. application Ser. No. 12/413,645, now U.S. Pat. No. 7,910,183, filed Mar. 30, 2009, entitled Layered Intermediate Transfer Members, the disclosure of which is totally incorporated herein by reference, illustrates an intermediate transfer member comprised of a polyimide substrate, and thereover a polyetherimide/polysiloxane.

Copending U.S. application Ser. No. 12/413,651, U.S. Publication No. 20100248106, filed Mar. 30, 2009, entitled Polyimide Polysiloxane Intermediate Transfer Members, the disclosure of which is totally incorporated herein by reference, illustrates an intermediate transfer member comprised of at least one of a polyimide/polyetherimide/polysiloxane, and a polyimide polysiloxane.

Copending U.S. Application No. 12/413,783, U.S. Publication No. 20100248107, filed Mar. 30, 2009, entitled Glycoluril Resin And Polyol Resin Members, the disclosure of which is totally incorporated herein by reference, illustrates a process which comprises providing a flexible belt having at least one welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the seam with a resin mixture of a glycoluril resin and a polyol resin.

Copending U.S. application Ser. No. 12/413,795, U.S. Publication No. 20100248108, filed Mar. 30, 2009, entitled Glycoluril Resin And Polyol Resin Dual Members, the disclosure of which is totally incorporated herein by reference, illustrates a process which comprises providing a flexible belt having at least one welded seam extending from one parallel edge to the other parallel edge of the coating, the welded seam having a rough seam region comprising an overlap of two opposite edges; contacting the rough seam region with a heat and pressure applying tool; and smoothing out the rough seam region with heat and pressure applied by the heat and pressure applying tool, and subsequently coating the belt with a resin mixture of a glycoluril resin and a polyol resin.

Copending U.S. application Ser. No. 12/413,832, U.S. Publication No. 20100248104, filed Mar. 30, 2009, entitled Polyaniline Dialkylsulfate Complexes Containing Intermediate Transfer Members, the disclosure of which is totally incorporated herein by reference, illustrates an intermediate transfer member comprised of a polyaniline dialkylsulfate complex.

U.S. application Ser. No. 12/033,247, now U.S. Pat. No. 7,771,908, filed Feb. 19, 2008, entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated, poly(oxetane) polymer.

U.S. application Ser. No. 12/033,267, now U.S. Pat. No. 7,776,499, filed Feb. 19, 2008, entitled Overcoat Containing Fluorinated Poly(Oxetane) Photoconductors, the disclosure of which is totally incorporated herein by reference, discloses a photoconductor comprising a supporting substrate, a photogenerating layer, and at least one charge transport layer comprised of at least one charge transport component, and in contact with the charge transport layer an overcoat layer comprised of a polymer, an optional charge transport component, and a fluorinated poly(oxetane) polymer.

There is disclosed in copending U.S. application Ser. No. 11/768,318, U.S. Publication No. 20090004587, now U.S. Pat. No. 7,691,551, filed June 26, 2007, entitled Imaging Member, an imaging member comprising a substrate, an imaging layer thereon, and a crack-deterring backing layer located on a side of the substrate opposite the imaging layer; wherein the crack-deterring backing layer comprises a backing material selected from the group consisting of vinyl, polyethylene, polyimide, acrylic, paper, canvas, and a silicone.

There is disclosed in copending U.S. application Ser. No. 11/729,622, U.S. Publication No. 20080241720, now U.S. Pat. No. 7,662,525, filed March 29, 2007, entitled Anticurl Backside Coating (ACBC) Photoconductors, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

BACKGROUND

Curl occurs in layered photoreceptors primarily since each layer has a different thermal contraction coefficient, or due to shrinkage during the fabrication process. In particular, the charge transport layer usually has a higher contraction coefficient than the photoconductor supporting substrate. In forming the imaging member, the charge transport layer may be formed from a solution which is then heated or otherwise dried. As a result of the aforementioned mismatch, the higher contraction coefficient causes the imaging member to curl as the imaging member cools from the higher drying temperature down to ambient temperature. The anticurl backside coating (ACBC) layer is applied to flatten or substantially flatten the substrate.

In embodiments, the photoconductors disclosed herein include an ACBC layer on the reverse side of the supporting substrate of a belt photoconductor. The ACBC layer, which can be solution coated, such as for example, as a self-adhesive layer on the reverse side of the substrate of the photoreceptor, may comprise a number of suitable materials such as those components that may not substantially effect surface contact friction reduction and prevents or minimizes wear/scratch problems for the photoreceptor device. In embodiments, the mechanically robust ACBC layer of the present disclosure usually will not substantially reduce the layer's thickness over extended time periods to adversely effect its anticurling ability for maintaining effective imaging member belt flatness, for example when not flat, the ACBC layer may, but not necessarily will, cause undesirable upward belt curling which adversely impacts imaging member belt surface charging uniformity causing print defects which thereby prevent the imaging process from continuously allowing a satisfactory copy printout quality; moreover, ACBC layer wear also produces dirt and debris resulting in dusty machine operation condition. Since the ACBC layer is located on the reverse side of the photoconductor, it does not usually adversely interfere with the xerographic performance of the photoconductor, and decouples the mechanical performance from the electrical performance of the photoconductor.

Moreover, high surface contact friction of the ACBC layer against the machine, such as printers, subsystems can cause the development of undesirable electrostatic charge buildup. In a number of instances with devices, such as printers, the electrostatic charge builds up because of high contact friction between the ACBC layer and the backer bars which increases the frictional force to the point that it requires higher torque from the driving motor to pull the belt for effective cycling motion. In a full color electrophotographic apparatus, using a 10-pitch photoreceptor belt, this electrostatic charge build-up can be high due to the large number of backer bars used in the machine.

Additionally, in embodiments the disclosed ACBC layers possess antistatic characteristics, and a tunable resistivity where, for example, the resistivity of the ACBC layer can be controlled and changed gradually depending, for example, on the glycoluril resin/polyacetal resin ratio amount selected. Thus, for example, the surface resistivity of the ACBC layer increased from about $10^{10}$ to about $10^{12}$ ohm/sq when the glycoluril resin/polyacetal resin ratio varied from about 2/1 to about 1/2, and where the glycoluril resin functions as the conductive component, and the polyacetal resin functions as the nonconductive component. Further, primarily in view of the crosslinked resin ACBC layer mixture nature, where the crosslinking percentage densities vary and can be, for example, of from about 50 to about 100 percent, from about 70 to about 95 percent, from about 60 to about 90 percent, or from about 75 to about 100 percent, the ACBC layer exhibited excellent adhesion, and substantially no peeling, to substrates such as the PEN substrate of Example I, and with a polymer like a polycarbonate (PC) selected as the overcoat on the photoconductor ACBC layer no or minimal peel resulted, and also where the overcoat is scratch resistant and solvent resistant.

A conductive ACBC layer enables, for example, the elimination of an active power supply used to discharge the back of the belt in a xerographic printing apparatus thereby resulting in a cost saving. When backer bars are inadvertently cleaned with certain solvents like methanol, the polarity of the triboelectrically generated (or friction generated) charge changes, and the discharge power supply actually adds charge to the belt (it can only operate with one polarity) creating high drag forces and belt steering issues, a disadvantage eliminated with the ACBC layer containing photoconductor of the present disclosure.

The present disclosure relates generally to electrophotographic imaging members, inclusive of photoconductors. More specifically, the present disclosure relates to photoconductors having enhanced durability, and as compared to a known polytetrafluoroethylene doped ACBC layer, a slippery surface, a higher bulk conductivity, and excellent mechanical wear characteristics, and where the ACBC layer is located on the side of the substrate opposite that of the imaging layers. Also, the ACBC layer of the present disclosure possesses, in embodiments, resistance to airborne chemical contaminants, which can decrease the photoconductor service life. Typical chemical contaminants include solvent vapors, environment airborne pollutants, and corona species emitted by machine charging subsystems such as ozone. Further, the photoconductor in a xerographic system is subjected to constant mechanical interactions against various subsystems.

The ACBC layer in this disclosure can be a two layer or single layer structure. In the two layer structure, the bottom layer adjacent to the substrate provides anticurl functionality, and the top layer adjacent to the bottom layer provides wear resistance, slippery surface, and antistatic properties.

REFERENCES

A number of backing layer formulations is disclosed in U.S. Pat. Nos. 5,069,993; 5,021,309; 5,919,590; 4,654,284 and 6,528,226. However, there is a need to create an ACBC layer formulation that is conductive, where the resistivity can be controlled or tunable, that is where the resistivity can be preselected, has intrinsic properties that minimize or eliminate charge accumulation in photoconductors without sacrificing other electrical properties such as low surface energy. One ACBC design can be designated as an insulating polymer coating containing additives, such as silica or TEFLON®, to reduce friction against backer plates and rollers, but these additives tend to charge up triboelectrically due to rubbing resulting in electrostatic drag force that adversely affects the process speed of the photoconductor.

Photoconductors containing ACBC layers are illustrated in U.S. Pat. Nos. 4,654,284; 5,096,795; 5,919,590; 5,935,748; 5,069,993; 5,021,309; 6,303,254; 6,528,226, and 6,939,652.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No.

4,265,990, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 to about 100 parts, and preferably about 19 parts with 1,3-diiminoisoindolene ($DI^3$) in an amount of from about 1 to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 to 5 millimeters in diameter, at room temperature, about 25° C., for a period of from about 12 hours to about 1 week, and preferably about 24 hours.

The appropriate components, such as the supporting substrates, the photogenerating layer components, the charge transport layer components, the overcoating layer components, and the like, of the above-recited patents may be selected for the photoconductors of the present disclosure in embodiments thereof.

Embodiments

There are disclosed in various embodiments herein compositions, which when used on the reverse side of a substrate, provide tunable resistivity, anticurl, wear resistance, slippery surface characteristics, antistatic properties, and other advantages as illustrated herein to the imaging layer or layers. As the coating is positioned on the underside of the substrate, it usually does not interfere with the electrical properties of the imaging member. Thus, the mechanical performance of the outermost exposed layer on the backside of the substrate is separated from the electrical properties of the imaging layers.

Embodiments include an imaging member comprising a substrate, an imaging layer thereon, and an ACBC layer located on a side of the substrate opposite to the imaging layer; wherein the ACBC layer comprises at least one single layer, or two layers, and the single layer or the top layer of the two layers or the outermost exposed layer comprises a backing material of a glycoluril resin, and a polyacetal resin mixture inclusive of a crosslinked glycoluril/polyacetal mixture, and where crosslinking can be accomplished by subjecting the resin mixture to a catalytic reaction with, for example, an acid catalyst such as a p-toluenesulfonic acid or a blocked p-toluenesulfonic acid; and a photoconductor comprising, in sequence, a substrate, an imaging layer thereon, and a backing layer located on a side of the substrate opposite the imaging layer wherein the outermost layer of the backing layer adjacent to the substrate is comprised of a crosslinked mixture of a glycoluril resin and a polyacetal resin.

Aspects of the present disclosure relate to a photoconductor comprising a supporting media like a supporting substrate, an imaging layer thereon, and a backing layer located on a side of the substrate opposite the imaging layer wherein the outermost layer of the backing layer adjacent to the substrate is comprised of a glycoluril resin and a polyacetal resin mixture, and the imaging layer is comprised of a photogenerating layer, and thereover a charge transport layer; a photoconductor comprised of a single backing layer, thereover and in contact with a supporting substrate a photogenerating layer, and a charge transport layer, and wherein the backing layer is comprised of a crosslinked glycoluril resin and a polyacetal resin mixture; and a photoconductor comprised of a first backing layer, and thereover a second backing layer, in sequence thereover a supporting substrate, a photogenerating layer, a charge transport layer, and wherein the first layer of the backing layer is adjacent to the substrate, and the first layer is comprised of a polycarbonate, and the second layer of the backing layer is situated on top of the first layer, and is comprised of a crosslinked glycoluril resin/polyacetal resin mixture; a photoconductor comprised of a single backing layer, thereover a supporting substrate, a photogenerating layer, a charge transport layer, and wherein said backing layer is comprised of a crosslinked mixture of (1) a glycoluril resin, and (2) a polyacetal resin, wherein said crosslinking is from about 70 to about 99 percent, said glycoluril resin is represented by

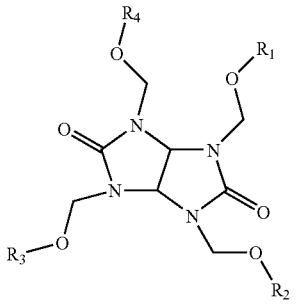

wherein each R substituent for said glycoluril resin independently represents a hydrogen atom or an alkyl; and said polyacetal resin is represented by

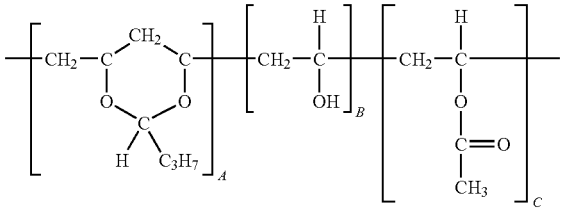

and for said polyacetal, A is from about 50 to about 95 mole percent, B is from about 5 to about 30 mole percent, and C is from about zero to about 10 mole percent; a photoconductor comprised of a first backing layer, and thereover a second backing layer; in sequence thereover a supporting substrate, a photogenerating layer, a charge transport layer, and wherein the first layer of the backing layer is adjacent to the substrate and is comprised of a polycarbonate, and the second layer of the backing layer is situated on top of the first layer, and is comprised of a crosslinked glycoluril resin/polyacetal resin; a photoconductor wherein the ACBC layer polyacetal resin is selected from the group consisting of polyvinyl butyral, polyvinyl isobutyral, polyvinyl propyral, polyvinyl acetacetal, polyvinyl formal, and copolymers thereof; and a photoconductor where the ACBC hydroxyl derivative of the perfluoropolyoxyalkane possesses a weight average molecular weight of from about 200 to about 2,000, a fluorine content of from about 45 to about 65 or from about 50 to about 60 percent, and a hydroxyl group selected from the group consisting of —$CH_2OH$, —$CH_2(OCH_2CH_2)_nOH$, —$CH_2OCH_2CH(OH)CH_2OH$, and mixtures thereof; the carboxylic acid or carboxylic ester derivatives of the fluoropolyether possesses a molecular weight average of from about 200 to about 2,000, and a fluorine content of from about 45 to about 75 percent or from about 50 to about 65 percent; the carboxylic ester derivatives of the perfluoroalkane selected for the ACBC layer possess a molecular weight average of from about 200 to about 2,000, a fluorine content of from about 45 to about 75 percent, and is represented by $R_fCH_2CH_2O(C{=}O)R$, wherein $R_f$ is $F(CF_2CF_2)_n$ and R is alkyl; the sulfonic acid derivatives of the perfluoroalkane possesses a molecular weight (weight average for these molecular weights) of from about 200 to about 2,000, a fluorine content of from about 45 to about 75 percent, and is represented by $R_fCH_2CH_2SO_3H$, wherein $R_f$ is $F(CF_2CF_2)_n$; the silane derivatives of the fluoropolyether possess a molecular weight of from about 1,000 to about 3,000, and the phosphate derivatives of the fluoropolyether possess a weight average molecular weight of from about 1,500 to about 5,000, and wherein n in the above formulas represents the number of repeating groups.

In various embodiments, the ACBC layer has a thickness of from about 1 to about 100 microns, from about 5 to about 50 microns, or from about 10 to about 30 microns. A single layer ACBC layer has a thickness of from about 1 to about 100 microns, from about 5 to about 50 microns, or from about 10 to about 30 microns. In a two layer ACBC layer, the bottom layer adjacent to the substrate has a thickness of from about 0.9 to about 99.9 microns, from about 5 to about 50 microns, or from about 10 to about 30 microns, and the top layer has a thickness of from about 0.1 to about 20 microns, from about 1 to about 10 microns, or from about 2 to about 6 microns.

Embodiments also further include an image forming apparatus for forming images on a recording medium comprising (a) a photoreceptor or photoconductor member to receive an electrostatic latent image thereon, wherein the photoreceptor member comprises a substrate, an imaging layer on a first side of the substrate, and a crosslinked resin mixture anticurl backside coating (ACBC) layer on a second side of the substrate; (b) a development component to develop the electrostatic latent image to form a developed image on the photoreceptor member; (c) a transfer component for transferring the developed image from the photoreceptor member to another member or a copy substrate; and (d) a fusing member to fuse the developed image to the other member or the copy substrate.

Aspects of the present disclosure relate to a photoconductor comprising a substrate, an imaging layer thereon, and a backing layer located on a side of the substrate opposite the imaging layer wherein the outermost layer of the backing layer adjacent to the substrate or the lower layers of the backing layer is comprised of a glycoluril and a polyacetal resin mixture with a thickness of from about 0.5 to about 30 microns; a photoconductor wherein the backing layer is comprised of a first and second layer, the first layer being adjacent to the substrate, and the first layer being comprised of a polymer selected from the group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof with a thickness of from about 1 to about 50 microns; and wherein the second layer is situated on top of the first layer, and which second layer is comprised of a crosslinked glycoluril resin and polyacetal resin mixture with a thickness of from about 0.1 to about 30 microns; a photoconductor wherein the first layer is comprised of a polycarbonate, and has a thickness of from about 10 to about 30 microns, and the second layer is comprised of a glycoluril resin and a polyacetal resin mixture, and has a thickness of from about 1 to about 10 microns; a photoconductor wherein the backing layer further includes an adhesive layer with a thickness of from about 0.01 to about 1 micron comprised of a material selected from the group consisting of silicone, rubber, and an acrylic resin situated between the substrate and the backing layer; a photoconductor wherein the layer further includes an acid catalyst selected in an amount of from about 0.01 to about 5 weight percent; a photoconductor wherein the acid catalyst is a toluenesulfonic acid selected in an amount of from about 0.1 to about 2 weight percent; a photoconductor comprised of a single layer backing layer, thereover a supporting substrate, a photogenerating layer, a charge transport layer, and wherein the backing layer is comprised of a glycoluril resin and a polyacetal resin mixture; a photoconductor comprised of a first backing layer and thereover a second backing layer, thereover a supporting substrate, a photogenerating layer, a charge transport layer, and wherein the first layer of the backing layer is adjacent to the substrate and is comprised of a polycarbonate, and the second layer of the backing layer is situated on top of the first layer, and is comprised of the crosslinked resin mixture illustrated herein and an acid catalyst; a photoconductor wherein the imaging layer is comprised of a photogenerating layer, and at least one charge transport layer comprised of at least one charge transport component; a photoconductor wherein the charge transport component is comprised of at least one of aryl amine molecules

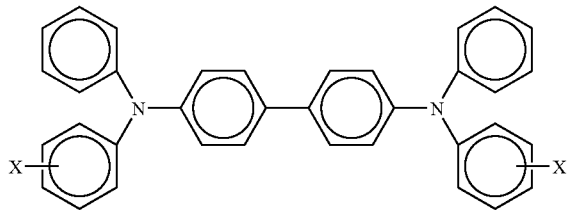

and

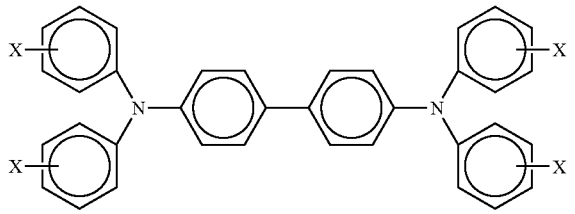

wherein X is selected from the group consisting of at least one of alkyl, alkoxy, aryl, and halogen; a photoconductor wherein the charge transport component is comprised of

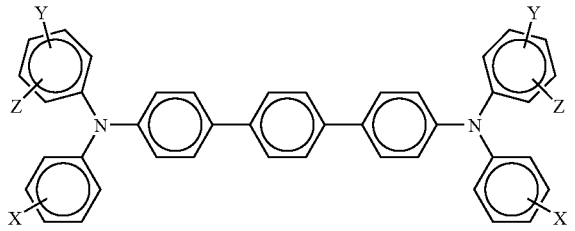

wherein X, Y and Z are independently selected from the group consisting of at least one of alkyl, alkoxy, aryl, and halogen; a photoconductor wherein the charge transport component is an aryl amine selected from the group consisting of N,N'-diphenyl-N,N-bis(alkylphenyl)-1,1-biphenyl-4,4'-diamine wherein alkyl is selected from the group consisting of methyl, ethyl, propyl, butyl, hexyl, and the like, N,N'-diphenyl-N,N'-bis(halophenyl)-1,1'-biphenyl -4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-2,5-dimethylphenyl)-[p-terphenyl]-4,4'-diamine, N,N'-diphenyl-N,N'-bis(3-chlorophenyl)-[p-terphenyl]-4,4'-diamine, and optionally mixtures thereof; a photoconductor wherein the charge transport component is comprised of aryl amine mixtures; a photoconductor wherein the imaging layer further includes in at least one of the charge transport layers an antioxidant comprised of a hindered phenolic and a hindered amine; a photoconductor wherein the photogenerating layer is comprised of a photogenerating pigment or photogenerating pigments; a photoconductor wherein the photogenerating pigment is comprised of at least one of a metal phthalocyanine, metal free phthalocyanine, a perylene, and mixtures thereof; a photoconductor further including a hole blocking layer, and an adhesive layer, and wherein the substrate is comprised of a conductive material; a photoconductor wherein the at least one charge transport layer is from 1 to about 4 layers; and a photoconductor wherein the substrate is a flexible web.

Also disclosed is a photoconductor comprising a substrate, an imaging layer thereon, and a backing layer located on a side of the substrate opposite the imaging layer, that is where the backing layer can be in contact with the reverse side of the substrate, and which backing layer is not in contact with the photogenerating layer or charge transport layer, wherein the outermost layer of the backing layer adjacent to the substrate is comprised of a mixture of glycoluril resin and a polyacetal resin mixture.

Examples of the ACBC Layer Components

Embodiments include an imaging member comprising a substrate, an imaging layer thereon, and an ACBC layer located on a side of the substrate opposite to the imaging layer wherein the ACBC layer comprises a single layer or a two layer structure, and the single layer or the top layer of the two layer structure, or the outermost exposed layer comprises a backing material of a glycoluril resin, and a polyacetal resin mixture.

In a two layer ACBC structure, the first or bottom layer adjacent to the substrate comprises a polymer selected, for example, from a group consisting of polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the polymer is comprised of a polycarbonate resin with a molecular weight of from about 20,000 to about 100,000, and more specifically, with a molecular weight $M_w$ of from about 50,000 to about 100,000. The second or top layer on top of the first or bottom layer comprises a backing material of a glycoluril resin and a polyacetal resin mixture.

Examples of the glycoluril resin, present in the ACBC layer in an amount, for example, of from about 20 to about 90 weight percent or from about 50 to about 70 weight percent of the total ACBC layer components, can be represented by the following formula/structure

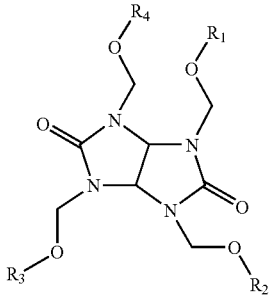

wherein each R substituent independently represents a hydrogen atom or an alkyl as illustrated herein with, for example, up to about 20 carbon atoms, from 1 to about 8 carbon atoms, or from 1 to about 4 carbon atoms.

Examples of the glycoluril resin include unalkylated and highly alkylated glycoluril resin. CYMEL® and POWDERLINK® glycoluril resins are commercially available from CYTEC Industries, Inc. Specific examples of the disclosed glycoluril resin include CYMEL® 1170 (a highly butylated resin with at least 75 percent of the R groups being butyl and the remainder of the R groups being hydrogen; viscosity=3,000 to 6,000 centipoise at 23° C.), CYMEL® 1171 (a highly methylated-ethylated with at least 75 percent of the R groups being methyl/ethyl and the remainder of the R groups being hydrogen, viscosity=3,800 to 7,500 centipoise at 23° C.), CYMEL® 1172 (an unalkylated resin with the R groups being hydrogen), and POWDERLINK® 1174 (a highly methylated resin with at least 75 percent of the R groups being methyl, and the remainder of the R groups being hydrogen, solid at 23° C.).

Specific examples of the disclosed glycoluril resin include CYMEL® 1170 (a highly butylated resin with from about 75 to about 95 percent of the R groups being butyl and the remainder of the R groups, that is from about 5 to about 25 percent, being hydrogen with a viscosity of from about 3,000 to about 6,500 centipoise, and from about 4,000 to about 5,000 centipoise at 23° C.), CYMEL® 1171 (a highly methylated-ethylated with from about 75 to about 95 percent of the R groups being methyl/ethyl and the remainder of the R groups being hydrogen, and with a viscosity of from 3,800 to about 7,500 centipoise, or from about 4,500 to about 6,000 centipoise at 23° C.), CYMEL® 1172 (an unalkylated resin with all of the R groups being hydrogen), and POWDERLINK® 1174 (a highly methylated resin with from about 75 to about 100 percent, and from about 80 to about 95 percent of the R groups being methyl and the remainder of the R groups being hydrogen, and which is a solid at 23° C.).

The number average molecular weight of the glycoluril resin is, for example, from about 200 to about 1,000 or from about 250 to about 600. The weight average molecular weight of the glycoluril resin is, for example, from about 230 to about 3,000 or from about 280 to about 1,800. The glycoluril resin is present in an amount of from about 20 to about 90 weight percent or from about 50 to about 70 weight percent of the total ACBC layer.

Examples of the polyacetal resin includes polyvinyl butyral (PVB) formed by the well known reaction between an aldehyde and an alcohol. For example, the addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction, and the concentration of the particular aldehyde and polyvinyl alcohol used are controlled to form polymers containing predetermined proportions of hydroxyl groups, acetate groups, and acetal groups.

The polyvinyl butyral selected for the ACBC layer can be represented by

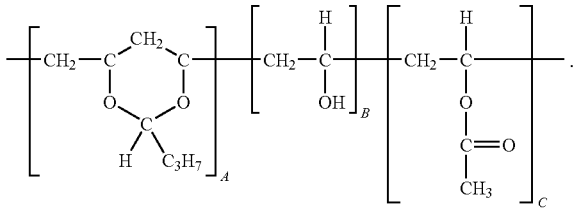

The proportions of polyvinyl butyral (A), polyvinyl alcohol (B), and polyvinyl acetate (C) are controlled, and are randomly distributed along the molecule. The mole percent of polyvinyl butyral (A) is, for example, from about 50 to about 95, that of polyvinyl alcohol (B) is, for example, from about 5 to about 30, and that of polyvinyl acetate (C) is, for example, from about 0 to about 10.

In addition to polyvinyl butyral (A), other polyvinyl acetals can be optionally present in the molecule including polyvinyl isobutyral (D), polyvinyl propyral (E), polyvinyl acetacetal (F), and polyvinyl formal (G). The total mole percent of all the monomeric units in one molecule is about 100.

Examples of the polyvinyl butyral resin include BUTVAR™ B-72 ($M_w$=170,000 to 250,000, A=80, B=17.5 to 20, C=0 to 2.5), B-74 ($M_w$=120,000 to 150,000, A=80, B=17.5 to 20, C=0 to 2.5), B-76 ($M_w$=90,000 to 120,000, A=88, B=11 to 13, C=0 to 1.5), B-79 ($M_w$=50,000 to 80,000, A=88, B=10.5 to 13, C=0 to 1.5), B-90 ($M_w$=70,000 to 100,000, A=80, B=18 to 20, C=0 to 1.5), and B-98 ($M_w$=40,000 to 70,000, A=80, B=18 to 20, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), and BX-2 (degree of polymerization=1,700, A=45, B=33, G=20), all commercially available from Sekisui Chemical Co., Ltd., Tokyo, Japan.

The weight average molecular weight of the polyacetal resin is, for example, from about 10,000 to about 500,000 or from about 40,000 to about 250,000. The polyacetal resin is present in the ACBC layer in an amount of, for example, from about 10 to about 80 weight percent or from about 30 to about 50 weight percent of the total ACBC layer components.

The disclosed ACBC layer further comprises an acid catalyst to accelerate the crosslinking reactions between the two resins. Non-limiting examples of catalysts include oxalic acid, maleic acid, carboxylic acid, ascorbic acid, malonic acid, succinic acid, tartaric acid, citric acid, p-toluenesulfonic acid, methanesulfonic acid, dodecylbenzene sulfonic acid, dinonylnaphthalene disulfonic acid, dinonylnaphthalene monosulfonic acid, and the like, and mixtures thereof, and their blocked latent forms such as amine blocked acids. A typical concentration of acid catalyst is from about 0.01 to about 5 weight percent or from about 0.5 to about 2 weight percent based on the total weight of the two resins.

The disclosed ACBC layer may further comprise, in embodiments, a siloxane component or a fluoro component present in an amount of from about 0.1 to about 20 weight percent or from about 0.5 to about 5 weight percent, which component can co-crosslink with the ACBC two resins to thereby permit an ACBC layer with slippery characteristics.

Examples of the crosslinkable siloxane component include hydroxyl derivatives of silicone modified polyacrylates such as BYK-SILCLEAN® 3700; a polyether modified acryl polydimethylsiloxanes such as BYK-SILCLEAN® 3710; and polyether modified hydroxyl polydimethylsiloxanes such as BYK-SILCLEAN® 3720. BYK-SILCLEAN® is a trademark of BYK.

Examples of the crosslinkable fluoro component include (1) hydroxyl derivatives of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group —$CH_2OH$); FLUOROLINK® E (M.W. of about 1,000 and a fluorine content of about 58 percent), and FLUOROLINK® E10 (M.W. of about 500 and fluorine content of about 56 percent) (functional group —$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); (2) hydroxyl derivatives of perfluoroalkanes ($R_fCH_2CH_2OH$ wherein $R_f$=$F(CF_2CF_2)_n$) wherein n represents the number of groups, such as about 1 to about 50, such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C. (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$ wherein $R_f$=$F(CF_2CF_2)_n$, and n is as illustrated herein, and R is alkyl) such as ZONYL° TA-N (fluoroalkyl acrylate, R=$CH_2$=CH—, M.W. of about 570 and fluorine content of about 64 percent), ZONYL° TM (fluoroalkyl methacrylate, R=$CH_2$=$C(CH_3)$—, M.W. of about 530 and fluorine content of about 60 percent), ZONYL° FTS (fluoroalkyl stearate, R=$C_{17}H_{35}$—, M.W. of about 700 and fluorine content of about 47 percent), ZONYL° TBC (fluoroalkyl citrate, M.W. of about 1,560 and fluorine content of about 63 percent); (6) sulfonic acid derivatives of perfluoroalkanes ($R_fCH_2CH_2\ SO_3H$, wherein $R_f$=$F(CF_2CF_2)_n$, and n is as illustrated herein), such as ZONYL° TBS (M.W. of about 530 and fluorine content of about 62 percent); (7) ethoxysilane derivatives of fluoropolyethers such as FLUOROLINK° S10 (M.W. of about 1,750 to about 1,950); and (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

In embodiments, the ACBC layer is comprised of the glycoluril resin, such as CYMEL® 1170, selected in an amount of from about 30 to about 70 percent by weight; the polyacetal resin, such as S-LEC™ BM-1 selected in an amount of from about 70 to about 30 percent by weight; and at least one of a crosslinkable siloxane selected in an amount of from about 0.5 to about 2 percent by weight, and a crosslinkable fluoro component, selected in an amount of from about 0.5 to about 2 percent by weight; examples of these components being hydroxyl derivatives of silicone modified polyacrylates such as BYK-SILCLEAN® 3700; a polyether modified acryl polydimethylsiloxanes such as BYK-SILCLEAN® 3710; and polyether modified hydroxyl polydimethylsiloxanes such as BYK-SILCLEAN® 3720. BYK-SILCLEAN® is a trademark of BYK. Examples of the crosslinkable fluoro component include (1) hydroxyl derivatives of perfluoropolyoxyalkanes such as FLUOROLINK® D (M.W. of about 1,000 and a fluorine content of about 62 percent), FLUOROLINK® D10-H (M.W. of about 700 and fluorine content of about 61 percent), and FLUOROLINK® D10 (M.W. of about 500 and fluorine content of about 60 percent) (functional group —$CH_2OH$); FLUOROLINK® E (M.W. of about 1,000 and a fluorine content of about 58 percent), and FLUOROLINK® E10 (M.W. of about 500 and fluorine content of about 56 percent) (functional group —$CH_2(OCH_2CH_2)_nOH$); FLUOROLINK® T (M.W. of about 550 and fluorine content of about 58 percent), and FLUOROLINK® T10 (M.W. of about 330 and fluorine content of about 55 percent) (functional group —$CH_2OCH_2CH(OH)CH_2OH$); (2) hydroxyl derivatives of perfluoroalkanes ($R_fCH_2CH_2OH$ wherein $R_f$=$F(CF_2CF_2)_n$, and wherein n represents the number of groups, such as about 1 to about 50), such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); (3) carboxylic acid derivatives of fluoropolyethers such as FLUOROLINK® C. (M.W. of about 1,000 and fluorine content of about 61 percent); (4) carboxylic ester derivatives of fluoropolyethers such as FLUOROLINK® L (M.W. of about 1,000 and fluorine content of about 60 percent), FLUOROLINK® L10 (M.W. of about 500 and fluorine content of about 58 percent); (5) carboxylic ester derivatives of perfluoroalkanes ($R_fCH_2CH_2O(C{=}O)R$, wherein $R_f$=$F(CF_2CF_2)_n$, n is as illustrated herein, and R is alkyl) such as ZONYL® TA-N (fluoroalkyl acrylate, R=$CH_2$=CH—, M.W. of about 570 and fluorine content of about 64 percent), ZONYL® TM (fluoroalkyl methacrylate, R=$CH_2$=$C(CH_3)$—, M.W. of about 530 and fluorine content of about 60 percent), ZONYL® FTS (fluoroalkyl stearate, R=$C_{17}H_{35}$—, M.W. of about 700 and fluorine content of about 47 percent), ZONYL® TBC (fluoroalkyl citrate, M.W. of about 1,560 and fluorine content of about 63 percent); (6) sulfonic acid derivatives of perfluoroalkanes ($R_fCH_2CH_2\ SO_3H$ wherein $R_f$=$F(CF_2CF_2)_n$, and n is as illustrated herein), such as ZONYL® TBS (M.W. of about 530 and fluorine content of about 62 percent); (7) ethoxysilane derivatives of fluoropolyethers such as FLUOROLINK® S10 (M.W. of about 1,750 to about 1,950); and (8) phosphate derivatives of fluoropolyethers such as FLUOROLINK® F10 (M.W. of about 2,400 to about 3,100). The FLUOROLINK® additives are available from Ausimont USA, and the ZONYL® additives are available from E.I. DuPont.

In other embodiments, the imaging member may further comprise an adhesive layer located on the reverse side of the substrate between the backing layer and the substrate. The adhesive layer may comprise an adhesive material selected from the group consisting of silicone, rubber, acrylic, and the like.

In embodiments, the adhesive layer and the backing layer may be applied together as a laminated self-adhesive. For example, commercial tapes normally comprise a backing and an adhesive. Exemplary commercial tapes that may be selected are vinyl tape, masking tape, or electrical tape. These types of tapes are distinguished by various features. A vinyl tape comprises a vinyl backing and an adhesive. Masking tape that may be selected comprises a paper backing and an adhesive. Electrical tape that may be selected comprises a vinyl backing and an adhesive. The electrical tape backing may be nonconducting, that is insulating, though this property is not required for crack resistance. The backing may also have elastic properties, that is a reversible elastic elongation in the tensile direction. The electrical tape adhesive provides adhesion for long periods of time, such as from months to years. The electrical tape adhesive may also be selected so as to preferentially adhere to the electrical tape backing, that is it sticks to the backing, not the surface to which the tape is applied. These types of tape are not mutually exclusive; for example a tape can be a vinyl tape and an electrical tape.

When desired, multiple ACBC layers may be applied to the reverse side of the imaging member. In particular, one or more laminated self-adhesive layers may be applied.

As, in embodiments, the ACBC layer increases crack resistance in the imaging layers (the photogenerating and charge transport layers), the outermost exposed layer on the front side of the imaging member does not usually need to provide crack resistance. Thus, the composition of the charge transport layer or the overcoat layer can be optimized to increase scratch resistance. For example, an overcoat layer formed from a composition of acrylic polyacetal binder, melamine-formaldehyde curing agent, and di-hydroxy biphenyl amine has excellent scratch resistance, but lacks somewhat in crack resistance properties. Such an overcoat layer, as disclosed in U.S. patent application Ser. No. 11/275,546 (Attorney Docket No. 20051247-US-NP), U.S. Publication 20070166634, filed Jan. 13, 2006, the disclosure of which is totally incorporated herein by reference, could be used in conjunction with the ACBC layer of the present disclosure. These overcoat layers may also comprise (i) a hydroxyl containing polymer (polyesters and acrylic polyacetals); (ii) a melamine-formaldehyde curing agent; and (iii) a hole transport material. The presence of a co-binder in the overcoat layer is associated with improved crack resistance. A co-binder may not be required in an imaging member comprising the ACBC layer of the present disclosure.

The ACBC layer also, in embodiments, possesses acceptable to excellent wear resistance. High wear resistance in the backing layer increases crack resistance in the imaging layer by preventing the formation of loose particulates that, when impacted between the substrate and the rollers in the imaging machine, produces cracks in the imaging layer(s). Also, the ACBC layer in the form of a clear coating is advantageous when, for example, the ACBC layer degrades, in that no or minimal conductive particle debris and no PTFE particle debris will be scattered in the machine, which can cause detrimental effects on printing. In embodiments, the ACBC layer is electrically conductive and a mechanically robust homogeneous layer, and where the conductivity of the ACBC layer can be changed by varying the weight ratio of the two crosslinking resins, and the surface friction of the ACBC layer can be readily adjusted by varying the amount of the siloxane or fluoro components.

Examples of the Photoconductor Layers

The thickness of the photoconductor substrate layer depends on many factors, including economical considerations, electrical characteristics, adequate flexibility, and the like, thus this layer may be of a substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose, including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly (vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyl) resins, cellulosic film formers, poly(amideimide), styrene-butadiene copolymers, vinylidene chloride-vinyl chloride copolymers, vinyl acetate-vinylidene chloride copolymers, styrene-alkyl) resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer, or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The hole blocking or undercoat layers for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 to about 80 weight percent, and more specifically, from about 55 to about 65 weight percent of a suitable component like a metal oxide, such as $TiO_2$, from about 20 to about 70 weight percent, and more specifically, from about 25 to about 50 weight percent of a phenolic resin; from about 2 to about 20 weight percent, and more specifically, from about 5 to about 15 weight percent of a phenolic compound preferably containing at least two phenolic groups, such as bisphenol S, and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 to about 75 microns, and more specifically, of a thickness of from about 10 to about 40 microns. Examples of charge transport components are aryl amines of the following formulas/structures

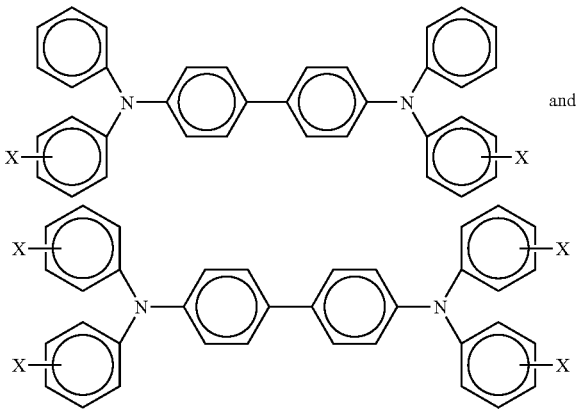

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas/structures

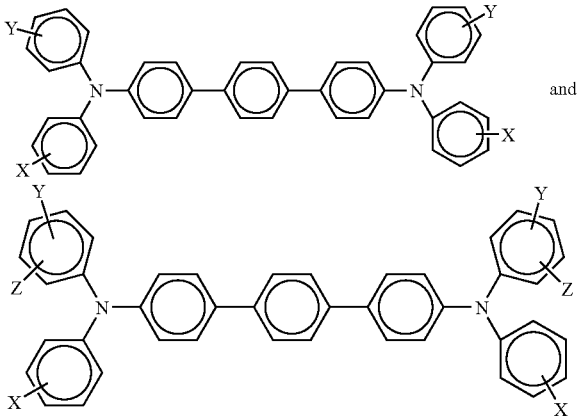

and wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'bis(4 butylphenyl)-N,N'-di-p-tolyl-[p-terphenyl]-4,4'diamine, N,N'-bis(4-butylphenyl)-N,N'-di-m-tolyl-[p-terphenyl]4,4'-diamine, N,N'-bis(4-butylphenyl)-N,N'-di-o-tolyl-[p-terphenyl]4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'- diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight ($M_w$) of from about 20,000 to about 100,000, or with a molecular weight ($M_w$) of from about 50,000 to about 100,000. Generally, the transport layer contains from about 10 to about 75 percent by weight of the charge transport material, and more specifically, from about 35 to about 50 percent by weight of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl) pyrazoline; aryl amines such as N,N'-diphenyl-N,N'-bis(3-methylphenyl)-(1,1'-biphenyl)-4,4'-diamine, N,N'-bis (4butylphenyl)-N,N'-di-p-tolyl-[terphenyl]4,4'diamine, N,N'bis(butylphenyl) N,N'-di-m-tolyl-[p-terphenyl]4,4'-diamine, N,N'-bis(4-butylphenyl)-N,N'-di-o-tolyl[p-terphenyl]4,4'-diamine, N,N'-bis(4-butylphenyl)-N,N'-bis-(4-isopropylphenyl)-[p-terphenyl]4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4 butylphenyl)-N,N'-di-p-tolyl-[p-terphenyl]4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layer, in embodiments, is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, U.S. Publication 20080107985, the disclosure of which is totally incorporated herein by reference, may be applied over the charge transport layer to provide abrasion protection.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoat charge transport layer, and where the transport layer is of a thickness of from about 40 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

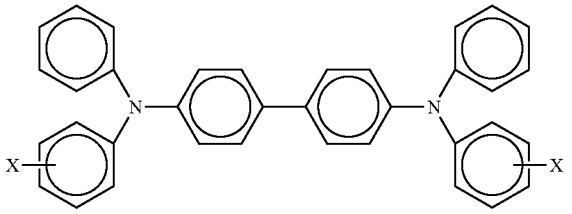

wherein X is selected from the group consisting of alkyl, alkoxy, aryl, and halogen; an imaging member wherein alkyl and alkoxy contain from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

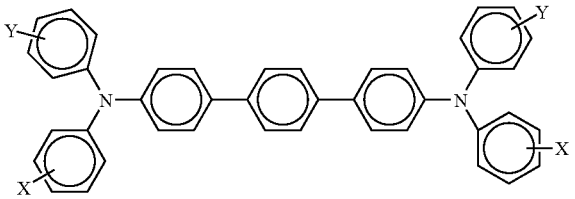

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chiorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying;

and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta) +/−0.2°) 7.4, 9.8, 12.4, 16.2, 17.6, 18.4, 21.9, 23.9, 25.0, 28.1 degrees, and the highest peak at 7.4 degrees; a method of imaging, which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component amount is from about 0.5 to about 20 weight percent, and wherein the photogenerating pigment is optionally dispersed in from about 1 to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogailium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6 -methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3 -chlorophenyl)-[b-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer, or, in embodiments, in contact with the photogenerating layer, and, in embodiments, wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer.

The photoconductor member may also include an optional ground strip layer comprised, for example, of conductive particles dispersed in a film forming binder, and may be applied to one edge of the photoreceptor to operatively connect the charge transport layer, photogenerating layer, and conductive layer for electrical continuity during electrophotographic imaging process. The ground strip layer may comprise any suitable film forming polymer binder and electrically conductive particles. Typical ground strip materials include those enumerated in U.S. Pat. No. 4,664,995, the disclosure of which is totally incorporated herein by reference. The ground strip layer may have a thickness from about 7 to about 42 microns, and more specifically, from about 14 to about 23 microns.

The following Examples further define and describe embodiments herein. Unless otherwise indicated, all parts and percentages are by weight.

COMPARATIVE EXAMPLE 1

A controlled anticurl backside coating layer (ACBC) solution was prepared by introducing into an amber glass bottle in a weight ratio of 8:92 VITEL® 2200, a copolyester of isoterephthalic acid, dimethylpropanediol, and ethanediol having a melting point of from about 302° C. to about 320° C. (degrees Centigrade), commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of a substrate of a biaxially oriented PEN, polyethylene naphthalate substrate (KALEDEX™ 2000) having a thickness of 3.5 mils, to form a coating of the anticurl backside coating layer that upon drying (120° C. for 1 minute) had a thickness of 17.4 microns. During this coating process, the humidity was equal to or less than 15 percent; and thereover, a 0.02 micron thick titanium layer coated (the coater device) on a biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer using a gravure applicator or an extrusion coater, and which adhesive contained 0.2 percent by weight based on the total weight of the solution of copolyester adhesive (ARDEL™ D100 available from Toyota Hsutsu Inc.) in a 60:30:10 volume ratio mixture of tetrahydrofuran/ monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a gravure applicator or an extrusion coater to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The photoconductor imaging member web was then coated over with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than about 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to about 15 percent.

COMPARATIVE EXAMPLE 2

A photoconductor was prepared by repeating the process of Comparative Example 1 except that the ACBC layer coating dispersion was prepared by adding polytetrafluoroethylene (PTFE) MP-1100 (DuPont) into the ACBC coating solution of Comparative Example 1, milling with 2 millimeter stainless shots at 200 rpm for 20 hours, and the resulting ACBC coating dispersion had the formulation of VITEL® 2200/MAKROLON® 5705/PTFE MP-1100=7.3/83.6/9.1 in methylene chloride with 9.7 weight percent of the solid. The resulting dispersion was applied on the back of the substrate, a biaxially oriented polyethylene naphthalate substrate (KALEDEX™ 2000) having a thickness of 3.5 mils, to form a coating of the anticurl backside coating layer that upon drying (120° C. for 1 minute) had a thickness of 18.7 microns. During this coating process, the humidity was equal to or less than 15 percent.

COMPARATIVE EXAMPLE 3

A photoconductor was prepared by repeating the process of Comparative Example 1 except that the ACBC layer solution was prepared by introducing into an amber glass bottle in a weight ratio of (A) 66:33:1, (B) 49.5:49.5:1, and (C) 33:66:1, respectively, CYMEL® 1170, a highly butylated glycoluril resin with about 75 percent 90 percent, and more specifically, 90 percent of the R groups being butyl, and the remaining 10 percent of the R groups being hydrogen; viscosity=4,500 centipoise at 23° C., commercially available from CYTEC Industries, Inc; JONCRYL® 580, a styrene acrylic resin, $T_g$=50° C., OH equivalent weight=350, acid number=10, $M_w$=15,000, commercially available from Johnson Polymers; and p-toluenesulfonic acid (pTSA). The resulting mixture was then dissolved in methylene chloride to form a solution containing 7.8 percent by weight solids. These solutions were applied on the back of a substrate, of a biaxially oriented polyethylene naphthalate substrate (KALEDEX™ 2000) having a thickness of 3.5 mils, to form a coating of the anticurl backside coating layer comprised of the glycoluril resin, the styrene acrylic resin, and the acid catalyst with a ratio of (A) 66:33:1, (B) 49.5:49.5:1, and (C) 33:66:1, respectively, that upon drying (130° C. for 2 minutes) had a thickness of 17.4 microns.

EXAMPLE I

A photoconductor was prepared by repeating the process of Comparative Example 1 except that the ACBC layer solution was prepared by introducing into an amber glass bottle in a weight ratio of (A) 66:33:1, (B) 49.5:49.5:1, and (C) 33:66:1, respectively, CYMEL® 1170, a highly butylated glycoluril resin with 90 percent of the R groups being butyl, and the remaining 10 percent of the R groups being hydrogen; viscosity equal to 4,500 centipoise at 23° C., commercially available from CYTEC Industries, Inc; a polyvinyl butyral S-LEC™ BM-1 (structure as below, degree of polymerization is 650, A=65±3, B=32, C=3),

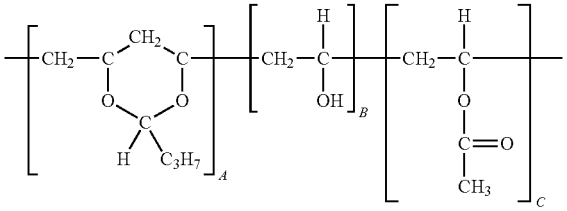

commercially available from Sekisui Chemical Co., Ltd., Tokyo, Japan; and an amine blocked p-toluenesulfonic acid, NACURE® XP-357, commercially available from King Industries.

The resulting mixture was then dissolved in methylene chloride to form a solution containing 7.8 percent by weight solids. These solutions were applied on the back of a substrate, of a biaxially oriented polyethylene naphthalate substrate (KALEDEX™ 2000) having a thickness of 3.5 mils, to form a coating of the anticurl backside coating layer comprised of the glycoluril resin, the polyvinyl butyral resin, and the acid catalyst with a ratio of (A) 66:33:1, (B) 49.5/49.5/1, and (C) 33:66:1, respectively, that upon drying (130° C. for 2 minutes) had a thickness of 17.4 microns, and a crosslinking percentage of about 90.

EXAMPLE II

A photoconductor was prepared by repeating the process of Comparative Example 1 except that a 2 micron second layer was coated on top of the existing ACBC layer situated on the backside of the photoconductor. The second layer solution was prepared by introducing into an amber glass bottle in a weight ratio of 66:33:1 CYMEL® 1170, a highly butylated glycoluril resin with 90 percent of the R groups being butyl, and 10 percent of the R groups being hydrogen; viscosity is 4,500 centipoise at 23° C., commercially available from CYTEC Industries, Inc; a polyvinyl butyral S-LEC™ BM-1 (structure as below, degree of polymerization 650, A=65±3, B=32, C=3),

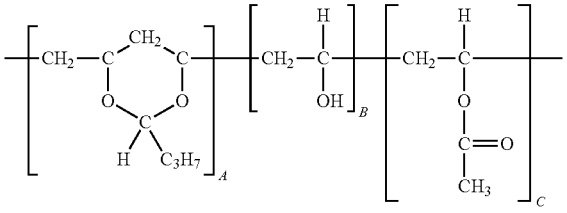

commercially available from Sekisui Chemical Co., Ltd., Tokyo, Japan; and an amine blocked p-toluenesulfonic acid, NACURE® XP-357, commercially available from King Industries.

The resulting mixture was then dissolved in n-butyl acetate to form a solution containing 15 percent by weight solids. This solution was applied on the existing ACBC layer to form a coating of the anticurl backside coating second layer comprised of the glycoluril resin, the polyvinyl butyral resin, and the acid catalyst with a ratio of 66:33:1 that upon drying (130° C. for 2 minutes) had a thickness of 2 microns.

EXAMPLE III

A photoconductor is prepared by repeating the process of Example TI except that a second layer solution is prepared by adding 2 weight percent of BYK-SILCLEAN® 3700, a hydroxyl derivative of silicone modified polyacrylate (siloxane component), commercially available from BYK, into the second layer solution of Example II. This solution is applied on the existing ACBC layer to form a coating of the anticurl backside coating second layer comprised of the glycoluril resin, the polyvinyl butyral resin, the acid catalyst, and the crosslinkable siloxane component with a ratio of 64.7:32.3:1:2 that upon drying (130° C. for 2 minutes) has a thickness of 2 microns.

Surface Resistivity Measurements

The surface resistivity of the ACBC layers were measured for the photoconductors with the ACBC layers of Comparative Examples 1, 2 and 3 (A), 3 (B), 3 (C), and the disclosed ACBC layers of Examples I (A), I (B) and I (C). The surface resistivity measurements were performed under 1,000 volts using a High Resistivity Meter (Hiresta-Up MCP-HT450 from Mitsubishi Chemical Corp.). Four to six measurements at varying spots (72° F./65 percent room humidity) were collected, and the surface resistivity results are shown in Table 1.

TABLE 1

| | Surface Resistivity (ohm/sq) |
|---|---|
| Comparative Example 1 | $10^{16}$ |
| Comparative Example 2 | $10^{16}$ |
| Comparative Example 1 (A) With a Glycoluril/Acrylic Polyol/Acid = 66:33:1 ACBC Layer | $2.8 \times 10^{11}$ |
| Comparative Example 1 (A) With a Glycoluril/Acrylic Polyol/Acid = 49.5:49.5:1 ACBC Layer | $3.5 \times 10^{12}$ |
| Comparative Example 1 (A) With a Glycoluril/Acrylic Polyol/Acid = 33:66:1 ACBC Layer | $2.0 \times 10^{13}$ |
| Example I (A) With a Glycoluril/Polyvinyl Butyral/Acid = 66:33:1 ACBC Layer | $1.3 \times 10^{10}$ |
| Example I (B) With a Glycoluril/Polyvinyl Butyral/Acid = 49.5:49.5:1 ACBC Layer | $2.1 \times 10^{11}$ |
| Example I (C) With a Glycoluril/Polyvinyl Butyral/Acid = 33:66:1 ACBC Layer | $1.1 \times 10^{12}$ |

The disclosed Example I ACBC layers were about 4 to 6 orders of magnitude more conductive than the Comparative Examples 1 and 2 ACBC layers, which indicated that less charge would be accumulated on the Example I ACBC layers with cycling. The disclosed Example I ACBC layers exhibited 4 to 6 orders of magnitude less resistivity, which indicated that whenever there was charge generation on the ACBC surface, the disclosed ACBC layer would dissipate the charge more rapidly than the Comparative Examples 1 and 2 controls, thus resulting in less charge accumulation, or more acceptable antistatic characteristics than the Comparative Examples 1 and 2 controls.

The above table data illustrates that the disclosed ACBC layers were antistatic, and that the resistivity changed gradually with the glycoluril resin/polyvinyl butyral resin ratio. Thus, the surface resistivity changed from about $10^{10}$ to about $10^{12}$ ohm/sq when the glycoluril resin/polyvinyl butyral resin ratio varied from 2/1 (Example I (A)) to 1/2 (Example I (C)). Noting that the conventional polycarbonate ACBC layer or PTFE-doped polycarbonate ACBC layer possesses a surface resistivity of about $10^{16}$ ohm/sq.

In addition, compared with an ACBC layer comprised of the glycoluril resin/the acrylic polyol resin of Comparative Example 3, the disclosed ACBC layer of Examples III and IV were about one order of magnitude less resistive when the ratio of the glycoluril resin in the ACBC layer was identical, which indicated that the disclosed ACBC layer was more antistatic.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, an imaging layer thereon, and a backing layer located on a side of the substrate opposite the imaging layer wherein an outermost layer of the backing layer adjacent to the substrate is comprised of a mixture of glycoluril resin and a polyacetal resin, wherein said backing layer comprises a single layer comprising said resin mixture, or said backing layer comprises two layers wherein an outermost layer adjacent to the substrate comprises said resin mixture.

2. A photoconductor in accordance with claim 1 wherein said glycoluril resin and said polyacetal resin are crosslinked, and wherein the backing layer has a thickness of from about 1 to about 50 microns.

3. A photoconductor comprising a substrate, an imaging layer thereon, and a backing layer comprised of a first and a second layer, the first layer being adjacent to said substrate, said first layer being comprised of a polymer selected from a group consisting of polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof with a first layer thickness of from about 1 to about 50 microns; and wherein said second layer is situated on top of the first layer, and which second layer is comprised of a mixture of a crosslinked glycoluril resin and a polyacetal resin with a second layer thickness of from about 0.1 to about 30 microns, and wherein said crosslinking percentage is from about 70 to about 99.

4. A photoconductor in accordance with claim 3 wherein said first layer is comprised of a polycarbonate and is of a thickness of from about 5 to about 30 microns, and said second layer is comprised of said crosslinked glycoluril resin/polyacetal resin mixture, and wherein said second layer is of a thickness of from about 1 to about 10 microns.

5. A photoconductor in accordance with claim 1 wherein said backing layer further includes an adhesive layer with a thickness of from about 0.01 to about 1 micron.

6. A photoconductor in accordance with claim 1 wherein said glycoluril resin is represented by

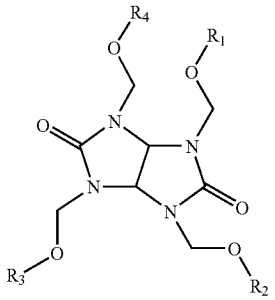

wherein each R group is at least one of hydrogen and alkyl with from about 1 to about 10 carbon atoms.

7. A photoconductor in accordance with claim 6 wherein said glycoluril resin possesses a number average molecular weight of from about 200 to about 1,000, and a weight average molecular weight of from about 230 to about 3,000, and each R group is alkyl with from about 1 to about 4 carbon atoms.

8. A photoconductor in accordance with claim 6 wherein said glycoluril resin possesses a number average molecular weight of from about 250 to about 600, and a weight average molecular weight of from about 280 to about 1,800, and each R is n-butyl, isobutyl, methyl, or ethyl.

9. A photoconductor in accordance with claim 1 wherein said polyacetal resin is selected from the group consisting of polyvinyl butyral, polyvinyl isobutyral, polyvinyl propyral, polyvinyl acetacetal, polyvinyl formal, and the copolymers thereof.

10. A photoconductor in accordance with claim 9 wherein said polyacetal is a polyvinyl butyral represented by

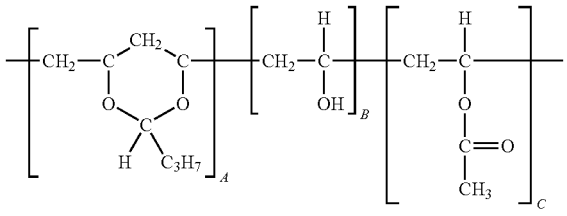

wherein A is from about 50 to about 95 mole percent, B is from about 5 to about 30 mole percent, and C is from about zero to about 10 mole percent.

11. A photoconductor in accordance with claim 10 wherein A is from about 60 to about 85 mole percent, B is from about 10 to about 20 mole percent, and C is from about 1 to about 8 mole percent.

12. A photoconductor in accordance with claim 10 wherein A is from about 60 to about 85 mole percent, B is from about 15 to about 25 mole percent, and C is from about 5 to about 10 mole percent.

13. A photoconductor in accordance with claim 9 wherein said polyacetal resin possesses a number average molecular weight of from about 8,000 to about 200,000, and a weight average molecular weight of from about 40,000 to about 250,000, and is a polyvinyl butyral resin.

14. A photoconductor in accordance with claim 1 wherein said glycoluril resin is present in an amount of from about 1 to about 99 percent, and said polyacetal resin is present in an amount of from about 99 to about 1 weight percent, and wherein the total thereof is about 100 percent.

15. A photoconductor in accordance with claim 1 wherein said glycoluril resin is present in an amount of from about 40 to about 80 percent, and said polyacetal resin component is present in an amount of from about 20 to about 60 weight percent, and wherein the total thereof is about 100 percent.

16. A photoconductor in accordance with claim 1 wherein said backing layer further includes an acid catalyst selected in an amount of from about 0.01 to about 5 weight percent.

17. A photoconductor in accordance with claim 16 wherein said acid catalyst is an amine blocked toluenesulfonic acid selected in an amount of from about 0.1 to about 2 weight percent.

18. A photoconductor in accordance with claim 1 wherein said backing layer further includes a siloxane component, or a fluoro component selected in an amount of from about 0.1 to about 20 weight percent.

19. A photoconductor in accordance with claim 18 wherein said siloxane component is a hydroxyl derivative of a silicone modified polyacrylate, a polyether modified acryl polydimethylsiloxane, or a polyether modified hydroxyl polydimethylsiloxane, and wherein said siloxane component is selected in an amount of from about 0.5 to about 5 weight percent.

20. A photoconductor in accordance with claim 18 wherein said fluoro component is at least one of hydroxyl derivatives of perfluoropolyoxyalkanes; hydroxyl derivatives of perfluoroalkanes; carboxylic acid derivatives of fluoropolyethers; carboxylic ester derivatives of fluoropolyethers; carboxylic ester derivatives of perfluoroalkanes; sulfonic acid derivatives of perfluoroalkanes; silane derivatives of fluoropolyethers; and phosphate derivatives of fluoropolyethers each selected in an amount of from about 0.5 to about 5 weight percent.

21. A photoconductor in accordance with claim 20 wherein said hydroxyl derivatives of said perfluoropolyoxyalkane have a weight average molecular weight of from about 200 to about 2,000, a fluorine content of from about 45 to about 65 percent, and a hydroxyl group selected from the group consisting of $—CH_2OH$, $—CH_2(OCH_2CH_2)_nOH$, $—CH_2OCH_2CH(OH)CH_2OH$, and mixtures thereof; said carboxylic acid or carboxylic ester derivatives of said fluoropolyether have a molecular weight average of from about 200 to about 2,000, and a fluorine content of from about 45 to about 75 percent; said carboxylic ester derivatives of said perfluoroalkane have a molecular weight average of from about 200 to about 2,000, a fluorine content of from about 45 to about 75 percent, and is represented by $R_fCH_2CH_2O(C{=}O)R$ wherein $R_f{=}F(CF_2CF_2)_n$, and R is alkyl; said sulfonic acid derivatives of said perfluoroalkane have a molecular weight of from about 200 to about 2,000, a fluorine content of from about 45 to about 75 percent, and is represented by $R_fCH_2CH_2SO_3H$, wherein $R_f{=}F(CF_2CF_2)_n$; said silane derivatives of said fluoropolyether have a molecular weight of from about 1,000 to about 3,000, and said phosphate derivatives of said fluoropolyether have a weight average molecular weight of from about 1,500 to about 5,000, wherein n represents the number of repeating groups.

22. A photoconductor comprised of a single backing layer, thereover a supporting substrate, a photogenerating layer, a charge transport layer, and wherein said backing layer is comprised of a crosslinked mixture of (1) a glycoluril resin, and (2) a polyacetal resin, wherein said crosslinking is from about 70 to about 99 percent, said glycoluril resin is represented by

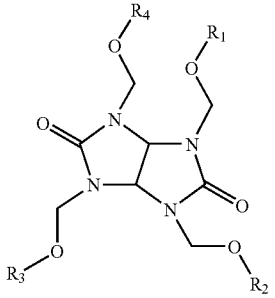

wherein each R substituent for said glycoluril resin independently represents a hydrogen atom or an alkyl; and said polyacetal resin is represented by

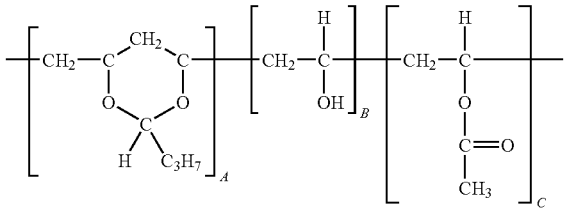

and wherein for said polyacetal A is from about 50 to about 95 mole percent, B is from about 5 to about 30 mole percent, and C is from about zero to about 10 mole percent.

23. A photoconductor comprised of a first backing layer and thereover a second backing layer; in sequence thereover a supporting substrate, a photogenerating layer, a charge transport layer, and wherein the first layer of said backing layer is adjacent to said substrate, and is comprised of a polycarbonate, and the second layer of said backing layer is situated on top of the first layer, and is comprised of a crosslinked glycoluril resin/polyacetal resin mixture.

24. A photoconductor in accordance with claim 1 wherein said imaging layer is comprised of a photogenerating layer, and at least one charge transport layer comprised of at least one charge transport component.

25. A photoconductor in accordance with claim 24 wherein said charge transport component is comprised of at least one of aryl amine molecules

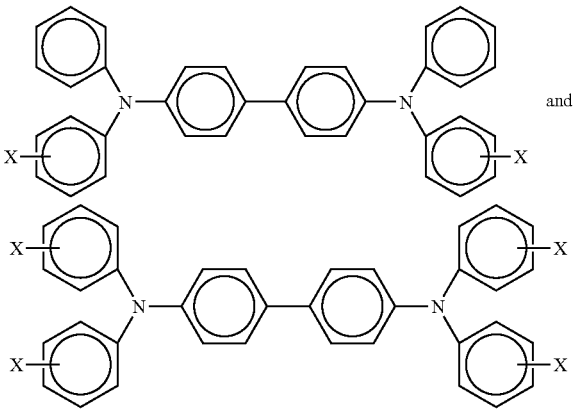

and wherein X is selected from the group consisting of at least one of alkyl, alkoxy, aryl, and halogen.

26. A photoconductor in accordance with claim 24 wherein said charge transport component is comprised of

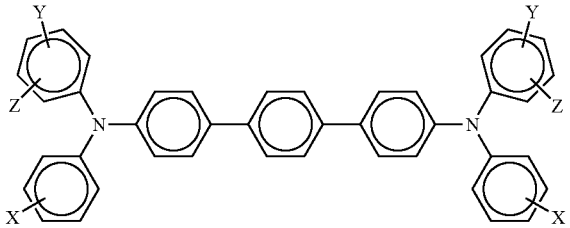

wherein X, Y and Z are independently selected from the group consisting of at least one of alkyl, alkoxy, aryl, and halogen.

27. A photoconductor in accordance with claim 24 wherein said charge transport component is selected from the group consisting of N,N'-diphenyl-N,N'-bis(alkylphenyl)-1,1-biphenyl-4,4'-diamine wherein alkyl is selected from the group consisting of methyl, ethyl, propyl, butyl, and hexyl, N,N'-diphenyl-N,N'-bis(halophenyl)-1,1'-biphenyl-4,4'-diamine wherein the halo substituent is a chloro substituent, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl) -N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis -(2-ethyl-6-methylphenyl)-[p-terphenyl]-4,4'-diamine, N,N'-bis(4-butylphenyl) -N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and optionally mixtures thereof.

28. A photoconductor in accordance with claim 24 wherein said imaging layer further includes in at least one of said charge transport layers an antioxidant comprised of a hindered phenolic and a hindered amine.

29. A photoconductor in accordance with claim 24 wherein said photogenerating layer is comprised of a photogenerating pigment or photogenerating pigments.

30. A photoconductor in accordance with claim 29 wherein said photogenerating pigment is comprised of at least one of a metal phthalocyanine, metal free phthalocyanine, a perylene, and mixtures thereof.

31. A photoconductor in accordance with claim 1 further including a hole blocking layer and an adhesive layer, and wherein said substrate is comprised of a conductive material.

32. A photoconductor in accordance with claim 24 wherein said at least one charge transport layer is from 1 to about 4 layers.

33. A photoconductor in accordance with claim 24 wherein said at least one charge transport layer is comprised of a first pass charge transport layer in contact with said photogenerating layer, and a second pass charge transport layer in contact with said first charge transport layer.

* * * * *